US008639435B2

(12) United States Patent
Fliegen

(10) Patent No.: US 8,639,435 B2
(45) Date of Patent: Jan. 28, 2014

(54) METHOD AND SYSTEM FOR CONCLUSIVELY CAPTURING A VIOLATION OF THE SPEED LIMIT ON A SECTION OF ROAD

(75) Inventor: Markus Fliegen, Viersen (DE)

(73) Assignee: Jenoptik Robot GmbH, Monheim (DE)

( * ) Notice: Subject to any disclaimer, the term of this patent is extended or adjusted under 35 U.S.C. 154(b) by 335 days.

(21) Appl. No.: 13/146,716

(22) PCT Filed: Nov. 16, 2009

(86) PCT No.: PCT/DE2009/050062

§ 371 (c)(1),
(2), (4) Date: Sep. 27, 2011

(87) PCT Pub. No.: WO2010/085931

PCT Pub. Date: Aug. 5, 2010

(65) Prior Publication Data

US 2012/0010804 A1 Jan. 12, 2012

(30) Foreign Application Priority Data

Jan. 28, 2009 (DE) ..... 10 2009 006 551

(51) Int. Cl.
*G08G 1/054* (2006.01)

(52) U.S. Cl.
USPC ..... 701/119; 340/936; 340/905

(58) Field of Classification Search
USPC ..... 701/36, 117, 119, 300, 93; 340/933, 340/936, 905, 988, 989, 425.5
See application file for complete search history.

(56) References Cited

U.S. PATENT DOCUMENTS

| | | | | |
|---|---|---|---|---|
| 6,121,898 | A | 9/2000 | Moetteli | |
| 8,542,096 | B2 * | 9/2013 | Pederson | 340/5.83 |
| 8,543,285 | B2 * | 9/2013 | Allen et al. | 701/30.5 |
| 2005/0151671 | A1 | 7/2005 | Bortolotto | |

FOREIGN PATENT DOCUMENTS

| | | | |
|---|---|---|---|
| CN | 1452138 | A | 10/2003 |
| CN | 1855169 | A | 11/2006 |
| EP | 1542191 | A1 | 6/2005 |
| WO | WO 02/082400 | A2 | 10/2002 |
| WO | WO 03/100518 | A2 | 12/2003 |

OTHER PUBLICATIONS

"Section Control", Openbaar Ministerie, Niederlande (Jul. 9, 2008), XP002574878, http://www.om.nl/onderwerpen/verkeer/english/section_control/ (Mar. 24, 2010).

* cited by examiner

*Primary Examiner* — Richard Camby
(74) *Attorney, Agent, or Firm* — Duane Morris LLP

(57) ABSTRACT

By means of the method according to the invention, a vehicle is detected when it drives into and out of a specified section of a roadway, the detection time is acquired, and an image recording in which the vehicle registration plate of the vehicle is detected is produced so as to be associated with each detection time. The image recordings in which the same vehicle registration plate was determined are correlated, and an average speed is determined from the difference of the associated detection times and the known length of the section of road and is compared with a specified maximum speed. If a speeding violation is determined, a high-resolution image recording of the driver of the vehicle is generated.

9 Claims, 2 Drawing Sheets

METHOD AND SYSTEM FOR CONCLUSIVELY CAPTURING A VIOLATION OF THE SPEED LIMIT ON A SECTION OF ROAD

RELATED APPLICATIONS

The present application is a U.S. National Stage application of International PCT Application No. PCT/DE2009/050062 filed on Nov. 16, 2009 which claims priority benefit of German Application No. DE 10 2009 006 551.2 filed on Jan. 28, 2009, the contents of which are incorporated herein by reference in their entirety.

FIELD OF THE INVENTION

The invention is directed to a method and an arrangement for checking compliance with a maximum speed specified for a section of road, wherein the vehicle registration plate and the time that a vehicle passes a first end point (entry point) and a second end point (exit point) of the section of road are captured, and a mean driving speed (average speed) of the vehicle is determined according to the path-time law by calculating the quotient from the length of the section of road and the difference of the passage times.

BACKGROUND OF THE INVENTION

A generic method and a generic arrangement are known from WO 02/082400.

Every year, speeding costs not only many human lives but also much money for medical care of the injured. Further, it causes immense property damage and also impedes the free flow of traffic. Therefore, a suitable and efficient monitoring of speed is especially important.

Radar equipment making use of the Doppler effect, for example, is used to determine and monitor the driving speed of vehicles. When the permissible speed limit is broken, one or more pictures of the vehicle are taken for purposes of documentation. Despite the efficiency of this method, monitoring is only carried out selectively at fixed or mobile points so that drivers who are aware of these monitoring points temporarily reduce their driving speed and then resume driving in excess of the permissible maximum speed.

In order to thwart this evasive behavior, a video-based measuring system was installed in the Kaisermühlen tunnel on A22 in Vienna which determines the average speed along a specified section of road and imposes a penalty when the permissible maximum speed is exceeded.

Further, International Patent Application WO 02/082400 A2 discloses an arrangement and a method for determining and storing an event in which the average speed is determined over one or more sections of road. To this end, at least two detection units are installed on the road at a distance of 500 meters or more from one another in order to determine the average speed in the section of road between the detection units and compare it with a permissible maximum speed.

When the first detection unit is passed, a first image of a vehicle is recorded, the time of the image recording is stored, and the registration number of the vehicle is determined by means of OCR (Optical Character Recognition).

When passing the next detection unit, where the vehicle is expected, a second image of the vehicle is recorded, the time of the image recording is stored, and the registration number of the vehicle is determined by OCR.

If a match is determined when comparing the vehicle registration numbers and a speeding violation is determined when the detected average speed is compared with the permitted maximum speed, a signal is sent to an output port which triggers a display device to alert the driver that he is driving at an excessive speed.

There is no suggestion in WO 02/082400 that the arrangement and the method are suitable for or intended for a conclusive capturing of a speed violation which is associated with an image recording in which the driver is discernible. Since vehicle registration number plate recognition is merely a matter of identifying alphanumeric symbols having a standardized typeface, low-resolution cameras can be used for this purpose so that these cameras are not only comparatively cheaper, but computing and storage resources are also advantageously minimized in an optimal manner.

The quantity of pixels required by a camera for vehicle registration plate recognition depends particularly upon the scene width of the image recording. When the camera is used for only one traffic lane, given an average traffic lane width of 3.6 m, then a 1.4-megapixel camera offers the minimum resolution needed for capturing a stroke thickness of a symbol of one centimeter with a good recognition rate.

Infrared-sensitive cameras are particularly well-suited for vehicle registration plate recognition because, in the infrared range, illumination can be carried out in the invisible region and the vehicle registration number plate has a particularly good reflectivity in both daytime and nighttime operation. Accordingly, sufficient contrast and brightness can be achieved in the image recordings with a corresponding illumination.

However, the intensity of the illumination is not sufficient for illuminating the passenger space.

Irrespective of the insufficient illumination of the passenger space in image recordings for capturing vehicle registration plates, the resolution is also insufficient to positively identify the driver's face.

If a high-resolution camera were used for capturing the vehicle registration plate so as also to enable the face of the driver to be discerned in this image recording and if a flash with sufficient intensity to illuminate the passenger space well enough to discern the face of the driver were generated at the same time, the reception area of the image recording device struck by the radiation reflected by the vehicle registration plate would be completely overloaded and vehicle registration plate recognition would no longer be possible.

Further, every triggering of an image recording of passing vehicles would be perceived by the driver, which is undesirable in cases where there is no traffic violation.

In countries such as Germany, where the costs-by-cause principle applies, image recordings for purposes of vehicle registration plate recognition for conclusive documentation of a speed violation are not sufficient by themselves to prosecute a speed violation.

OBJECTS OF THE INVENTION

It is the object of the invention to provide a method of the type mentioned in the beginning and an arrangement for implementing this method which supply conclusive documentation.

Another object of the invention is to find a method of the type mentioned above and an arrangement for implementing the method in which the average speed can be determined more accurately in an advantageous manner.

The object of the invention is met for a method for conclusively capturing a violation of a permissible maximum speed on a section of a roadway having at least one traffic lane in that a vehicle is detected and recorded when it passes, respectively, an entry point and an exit point of a section of road.

In so doing, the image recordings are rendered in such a way with respect to quality that they allow vehicle registration plate recognition by methods known for this purpose for optical character recognition (OCR).

Image recordings in which the same vehicle registration plates were detected are correlated with one another.

The times at which the vehicle is detected (hereinafter referred to as detection times) are acquired at the same time that the image recordings are triggered and are associated with the image recording of the respective detected vehicle.

The registration plates of the vehicles are searched for and recognized in the image recordings by known methods for optical character recognition, and image recordings of the same vehicle are correlated with one another.

An average speed of the vehicle is determined from the detection times for the same vehicles and knowledge of the length of the section of road according to the path-time law by calculating the quotient from the length of the section of road and the difference of the detection times and is compared with a permissible maximum speed.

If this comparison shows that the average speed exceeds the permissible maximum speed by a predetermined value, a high-resolution image recording of the driver is triggered with simultaneous flash illumination. In so doing, the passenger space is illuminated in such a way that the driver can be identified in the image recording under all possible conditions (different driving speeds, different times of day, different shapes of windshield, and so on). Information needed for prosecuting the traffic violation such as the determined average speed, the permissible maximum speed, the vehicle registration plate recorded at the entry point and at the exit point, and place data and time data are superimposed in the image recording.

The flash is triggered specifically only in the event of a speeding violation. In this way, the rest of the traffic is disturbed as little as possible.

The high-resolution image recording of the vehicle is advantageously triggered when the vehicle is located at a predetermined photograph point lying after the exit point in the driving direction and, therefore, within a defined depth of field of the camera. Accordingly, the quality of the image recording combined with the deliberately triggered flash and, therefore, the discernability of the driver can be distinctly improved.

The predetermined photograph point lies at a sufficient distance after the exit point to ensure that, even at high speeds (e.g., >250 km/h), the time required for the vehicle to travel from the exit point to the photograph point is greater than the maximum time needed for transmitting the acquired data, recognizing the vehicle registration plate by means of OCR, checking whether or not a speed violation has occurred, and calculating the time required for the vehicle to travel from the exit point to the photograph point.

It is also advantageous when, in addition, the instantaneous velocity of a vehicle when passing the exit point is acquired and the high-resolution image recording is triggered at a photography time. The photography time is calculated beforehand according to the path-time law from the detected instantaneous velocity, which can also serve additionally as a second proof, and from the distance between the exit point and a predetermined photograph point.

Further, the instantaneous velocity of a vehicle when passing the entry point is advantageously detected, which can substantiate a reasonable suspicion or can serve as a second proof, to which end the instantaneous velocity is superimposed in the image recording.

In order to determine the average speed with high accuracy, the two detection times are advantageously acquired, respectively, by two timer units which are independent from one another, and two differences are calculated, by means of which differences two times are calculated, the longer of the two times being used for determining the average speed.

The two detection times are advantageously acquired, respectively, by different timer units and a radio-controlled timer unit, and the different timer units are synchronized with the radio-controlled timer unit when the deviation between the indicated times exceeds a predetermined value.

For an arrangement for conclusively capturing a violation of a permissible maximum speed on a section of a roadway having at least one traffic lane, the object according to the invention is met by a first detection unit connected to a first timer unit and a second detection unit connected to a second timer unit, wherein the first detection unit is arranged at an entry point of the section of road so as to be aligned with the road and the second detection unit is arranged at an exit point of the section of road so as to be aligned with the road. Instead of the one first detection unit and the one second detection unit, each of which is designed to detect vehicles regardless of which lane the vehicle is driving in, the first detection units and second detection units can be arranged in a quantity identical to that of the existing traffic lanes and, if desired, emergency lanes.

Every detection unit is associated with a camera, i.e., a first camera whose object field includes the entry point is connected to the first detection unit and to a first vehicle registration plate recognition unit, and a second camera whose object field includes the exit point is connected to the second detection unit and to a second vehicle registration plate recognition unit.

The units mentioned above are directly or indirectly connected to a computing and storage unit which is constructed in such a way that it compares the detected vehicle registration plates for a match and, as the case may be, determines the average speed of the vehicle from the acquired corresponding detection times and the known length of the section of road and compares this average speed with a specified maximum speed in order to transmit a signal when this maximum speed is exceeded.

It is essential to the invention that at least one additional camera, which communicates with the computing and storage unit and is directed to the roadway, and a flash connected to the camera are provided so that a high-resolution image recording of the driver can be triggered with simultaneous illumination in case a signal is sent.

In principle, an additional camera whose object field covers the entire width of the roadway can be sufficient, or a plurality of additional cameras can be arranged in such a way that their object fields collectively cover the width of the roadway. In this case, the additional cameras are usually arranged in such a way that each of them is associated with a traffic lane.

In addition to the first timer unit and second timer unit, a radio-controlled third timer unit which communicates with the first timer unit and second timer unit is advantageously provided.

In an advantageous manner, particularly for stationary arrangements, the additional camera is directed to the roadway in such a way that its object field includes a predetermined photograph point lying behind the exit point in the driving direction.

In an advantageous manner, particularly for mobile arrangements, a speed sensor is provided which is connected to the additional camera and to the computing and storage unit and which senses the instantaneous velocity of the vehicle at the exit point, and the computing and storage unit is constructed in such a way that it can determine, from the instantaneous velocity and from the known distance of a predetermined photograph point from the exit point, the time required for the vehicle to have arrived at the photograph point so as to trigger the additional camera after this time.

It is advantageous when the speed sensor is the second detection unit. In this case, the second detection unit is designed not only to detect the vehicle as such, but also to sense the instantaneous velocity thereof, and can be, e.g., a radar sensor or a horizontally positioned laser scanner.

A radar sensor and also the laser scanner can advantageously also acquire the detection location so that the vehicle can be associated with a traffic lane of the roadway and the additional camera associated with the relevant traffic lane is triggered.

It is advantageous for a stationary arrangement when the first detection unit and second detection unit are laser scanners which are mounted above the roadway such that their scanning plane is perpendicular to the roadway surface so that, first, the vehicle can be detected and, second, the top view of the vehicle can be captured for purposes of classification.

For a mobile arrangement, the detection units are advantageously laser scanners which are placed next to the roadway in such a way that the scanning plane of the first laser scanner is oriented vertically and the scanning plane of the second laser scanner is oriented horizontally so that the first laser scanner can detect the vehicle a first time and, for purposes of classification, can capture the side profile of the vehicle, and the second laser scanner can detect the vehicle a second time and can capture the instantaneous velocity thereof.

The section of road is advantageously outfitted with a variable message sign installation which communicates with the computing and storage unit so that the permissible maximum speed to be compared corresponds in each instance to the speed currently displayed by the variable message sign installation.

The arrangement according to the invention and the method according to the invention will be described more fully in the following by way of example with reference to drawings.

DESCRIPTION OF THE EMBODIMENTS

Figure 1A:
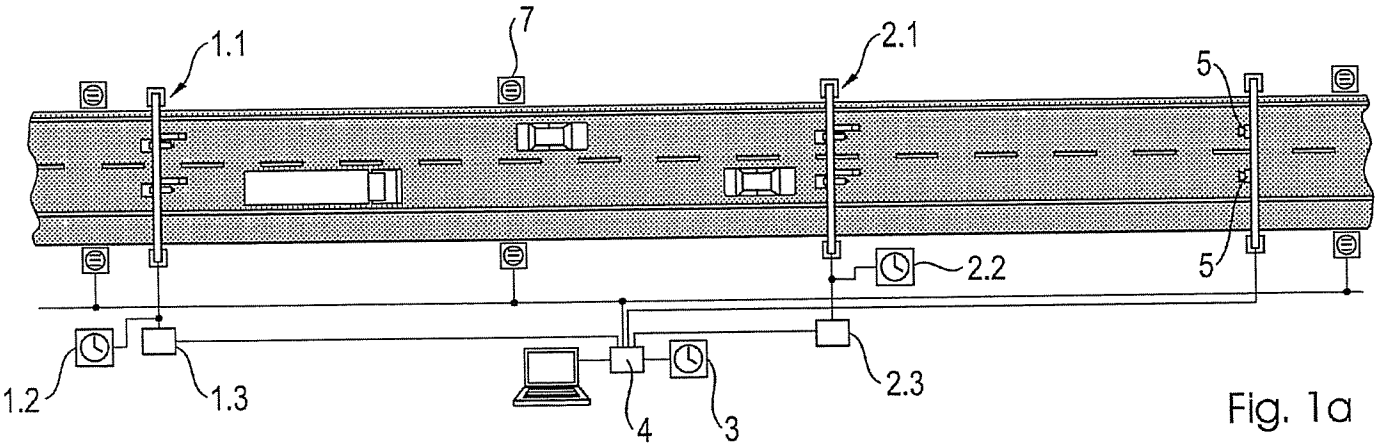
FIG. 1*a* a schematic top view of an embodiment example of an arrangement according to the invention.

FIG. 1*a* shows a top view of a roadway having two traffic lanes and a shoulder or emergency lane, and an advantageous embodiment of an arrangement according to the invention which is arranged so as to be stationary with respect to the roadway.

In order to acquire an average speed of vehicles along a determined section of the roadway, the vehicles are detected as they enter and exit a section.

Since the vehicle can theoretically drive into and out of the section at any distance from the roadside, there are theoretically an unlimited number of entry points and exit points lying on a line which define the section. Since a distinction is not relevant for understanding the invention, only one entry point E and one exit point A will be discussed in the following for the sake of simplicity.

As in the prior art, the arrangement comprises detection units which are either designed to detect vehicles driving in only one traffic lane or can detect all vehicles regardless of the traffic lane in which they are driving.

In the embodiment example shown herein, the detection units are designed in each instance for the width of a traffic lane and are arranged and aligned with respect to the roadway in such a way that they can detect a vehicle at the entry point E and at the exit point A, respectively.

Since it is also not relevant to the invention to differentiate the quantity of detection units with respect to the entry point E and with respect to the exit point A, only one first detection unit 1.1 which detects a vehicle at entry point E and one second detection unit 2.1 which detects a vehicle at exit point A will be referred to for the sake of simplicity.

Figure 1B:
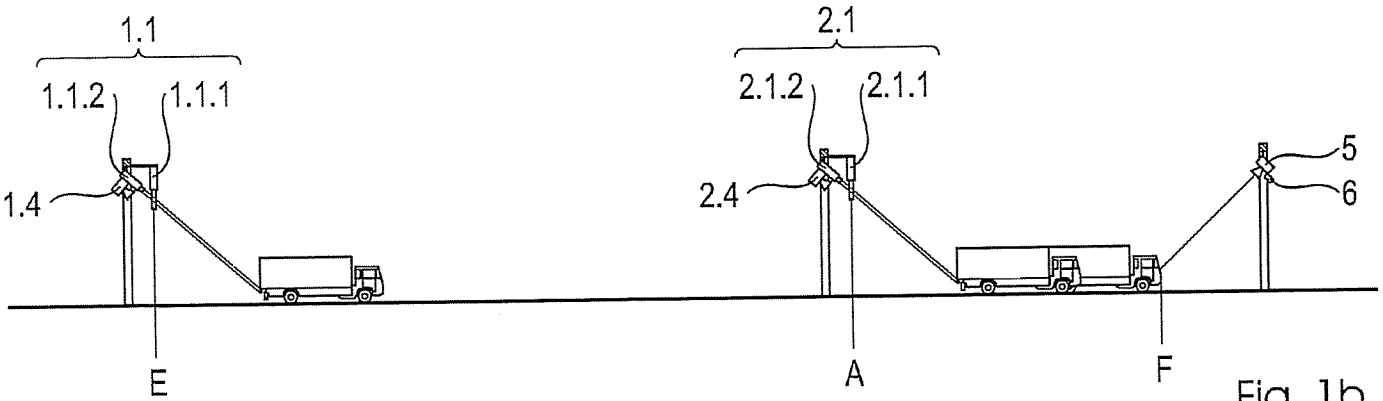
FIG. 1*b* a schematic side view of an embodiment example of an arrangement according to the invention.

According to the embodiment example shown in FIGS. 1*a* to 1*b*, the first detection unit 1.1 and second detection unit 2.1 are formed respectively by a laser scanner 1.1.1, 2.1.1 mounted above the roadway so as to be directed perpendicular to the roadway and a laser scanner 1.1.2, 2.1.2 mounted above the roadway so as to be directed obliquely with respect to the roadway. The laser scanner line described by the perpendicularly directed laser scanner 1.1.1 of the first detection unit 1.1 on the roadway defines entry point E. Correspondingly, the laser scanner line described by the perpendicularly directed laser scanner 2.1.1 of the second detection unit 2.1 on the roadway defines exit point A.

As was already mentioned, the two detection units 1.1, 2.1 advantageously have a laser scanner 1.1.2, 2.1.2, respectively, which is directed obliquely with respect to the roadway so that, on the one hand, it is possible to determine the vehicle profile in a manner known to the person skilled in the art and, on the other hand, the instantaneous velocity of the vehicle can also be acquired.

In addition to the detection units 1.1, 2.1, the arrangement must necessarily include a first timer unit 1.2, a first vehicle registration plate recognition unit 1.3, and a first low-resolution camera 1.4 which communicates with the first detection unit 1.1, and a second timer unit 2.2, a second vehicle registration plate recognition unit 2.3, and a second low-resolution camera 2.4 which communicates with the second detection unit 2.1.

The cameras 1.4, 2.4 are triggered, respectively, upon detection of a vehicle and produce an image recording from which the vehicle registration plate is found and identified in a manner known to the person skilled in the art by the vehicle registration plate recognition units 1.3, 2.3. A detection time acquired by the timer units 1.2, 2.2 is assigned in each instance to the image recordings.

By means of a computing and storage unit 4 which is connected at least to the vehicle registration plate recognition units 1.3, 2.3 and the timer units 1.2, 2.2, the detected vehicle registration plates are compared for a match and the image recordings in which the same vehicle registration plates have been found are correlated with one another. The time difference is calculated from the associated detection times and, based on knowledge of the length of the section of road, the average speed is calculated. Subsequently, the average speed is compared with a permissible maximum speed in the computing and storage unit 4 and, in case this permissible maximum speed was exceeded by a specified amount, an additional camera 5 and a flash 6 are triggered.

In the embodiment example shown herein, two additional cameras 5 are provided, each having a flash 6 associated with it, each of which additional cameras 5 is directed to a traffic lane.

The additional cameras 5 are arranged at a distance from the exit point A such that there is sufficient time to correlate the detected vehicle registration plates with one another, calculate the average speed, and compare the average speed to the permissible maximum speed before the detected vehicle drives into the object field of one of the other cameras 5.

The time at which one of the other cameras 5 is triggered is determined from the instantaneous velocity detected at exit point A and the knowledge of the distance of the additional cameras 5 from exit point A.

When an additional camera 5 is provided for each traffic lane, as in the present case, the traffic lane in which the vehicle is driving must also be determined from the signals received by the detection units 1.1, 2.1, which is possible for the embodiment of the detection units 1.1, 2.1 described above in a manner known to the person skilled in the art. With knowledge of the traffic lane in which the detected vehicle moves forward, the additional camera 5 associated with the respective traffic lane can then be triggered.

Instead of an additional camera 5 for each traffic lane, only one additional camera 5 whose object field captures the roadway over its entire width can also be provided in an advantageous manner. In this case, only the image area comprising the detected vehicle and its immediate surroundings is zoomed out of the image recording and stored. In this way, an image with sufficiently high resolution to allow the driver's face to be discerned is still obtained with a high-resolution camera such as is currently available.

The first camera 1.4 and second camera 2.4 are infrared-sensitive cameras. The requirements which must be met by cameras so that they can be used in an optimal manner for vehicle registration plate recognition were described in detail in the description of the prior art. The above-described requirements must also be met by the first camera 1.4 and second camera 2.4 of the arrangement according to the invention. Cameras having a receiver matrix of, e.g., 1.4 megapixels are preferably used. The image recordings can be produced in daylight and at night with a flash of low intensity. It is preferable to use an infrared flash which is invisible. In this way, the image recordings serving for vehicle registration plate recognition are not noticed by the driver.

In contrast, an additional camera or the plurality of additional cameras 5 must be selected in such a way, depending upon the flash 6 which is used, that an image recording can be produced in which the face of the driver is imaged in a recognizable manner with sufficient contrast and sufficient resolution.

Information such as average speed, date, time of day, and location needed for imposing a penalty for the speed violation is superimposed in the image recording for identifying the driver.

In addition, the instantaneous velocity at the entry point E and/or exit point A can also be superimposed in the image recording in order additionally to punish an instantaneous velocity violation according to national legislation at the entry point E and/or exit point A, to use as a second proof, or to substantiate a reasonable suspicion.

Instead of the laser selected as detection unit 1.1, 2.1 in the first embodiment example and the arrangement thereof above the roadway, other sensors within the broadest sense which function as detection unit 1.1, 2.1 can also be used.

For example, radar sensors or laser scanners positioned next to the road can be used for mobile arrangements.

For stationary arrangements, inductive loops or piezo sensors can also be inserted into the roadway surface.

The calculated average speed can also be compared with vehicle-specific permissible maximum speeds by using detection units which capture the vehicle profile.

The computing and storage unit 4 can compare the calculated average speed either with permissible maximum speeds which were entered manually or with permissible maximum speeds which it obtains from a variable message sign installation 7 which is connected to it and which displays different permissible maximum speeds depending, for example, on the traffic density or visibility.

In order to accurately determine the average speed, the deviation of the synchronism of the first timer unit 1.2 and second timer unit 2.2 may not exceed a specified tolerance.

Therefore, there is advantageously a radio-controlled third timer unit 3 which communicates with the first timer unit 1.2 and second timer unit 2.2. The deviation of the time indicated by the first timer unit 1.2 and second timer unit 2.2 is compared to the time of the radio-controlled third timer unit 3 at regular intervals and, when a specified tolerance deviation is exceeded, the first and/or second timer unit 1.2, 2.2 is readjusted and accordingly synchronized with the time of the radio-controlled third timer unit 3.

The radio-controlled third timer unit 3 can also communicate with the first detection unit 1.1 and second detection unit 2.1 in addition and can acquire the detection times so that there are, in each instance, two detection times for vehicles passing the section of road when passing entry point E and when passing exit point A, which provides twofold certainty. In this case, the greater time difference is used to determine the average speed.

In this case, both of the time values obtained are also advantageously superimposed in the image recording as entry times and exit times.

REFERENCE NUMERALS

1.1 first detection unit
1.1.1 perpendicularly directed laser scanner of the first detection unit 1.1
1.1.2 obliquely directed laser scanner of the first detection unit 1.1
1.2 first timer unit
1.3 first vehicle registration plate recognition unit
1.4 first camera
2.1 second detection unit
2.1.1 perpendicularly directed laser scanner of the second detection unit 2
2.1.2 obliquely directed laser scanner of the second detection unit 2.1
2.2 second timer unit
2.3 second vehicle registration plate recognition unit
2.4 second camera
3 radio-controlled third timer unit
4 computing and storage unit
5 additional camera
6 flash
7 variable message sign installation
E entry point
A exit point
F photograph point While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed is:

1. Method for conclusively capturing a violation of a permissible maximum speed on a section of a roadway having at least one traffic lane, wherein a vehicle is detected at a detection time and an image is recorded when the vehicle passes, respectively, an entry point and an exit point of a section of road, and the respective detection time is acquired, and the respective image recording is correlated, the vehicle registration plates of the passing vehicles are detected from the image recordings, and the image recordings of vehicles having the same vehicle registration plate are correlated with one another, an average speed of a vehicle is determined from the detection times for a same vehicle and knowledge of the length of the section of road according to the path-time law by calculating the quotient from the length of the section of road and the difference of the detection times, and the average speed is compared with a permissible maximum speed, wherein a high-resolution image recording of the driver of the vehicle is triggered with simultaneous flash illumination when the average speed exceeds the permissible maximum speed by a predetermined value, and the passenger space of the vehicle is illuminated in such a way that the driver can be identified in the image recording, and information needed for prosecuting the traffic violation such as the determined average speed, the permissible maximum speed, the vehicle registration plate recorded at the entry point and at the exit point, and place data and time data are superimposed in the image recording, characterized in that the two detection times are acquired, respectively, by two timer units which are independent from one another, and two differences are calculated, the greater of the two being used for determining the average speed.

2. Method according to claim 1, characterized in that the two detection times are acquired, respectively, by two timer units which are independent from one another and a radio-controlled third timer unit, and the different timer units are synchronized with the radio-controlled third timer unit when the deviation between the indicated times exceeds a predetermined value.

3. Method according to claim 1, characterized in that the instantaneous velocity of a vehicle when passing the exit point is acquired in addition, and the high-resolution image recording is triggered at a photography time, wherein the photography time is calculated beforehand according to the path-time law from the detected instantaneous velocity at the exit point and the distance between the exit point and a predetermined photograph point.

4. Method according to claim 1, characterized in that the instantaneous velocity of the vehicle when passing the entry point is acquired in addition.

5. Arrangement for conclusively capturing a violation of a permissible maximum speed on a section of a roadway having at least one traffic lane, having a first detection unit connected to a first timer unit and a second detection unit connected to a second timer unit, wherein the first detection unit is arranged at an entry point of the section of road so as to be aligned with the road and the second detection unit is arranged at an exit point of the section of road so as to be aligned with the road, a first camera whose object field includes the entry point and which is connected to the first detection unit and to a first vehicle registration plate recognition unit, and a second camera whose object field includes the exit point and which is connected to the second detection unit and to a second vehicle registration plate recognition unit, and a computing and storage unit which is constructed in such a way that it compares the detected vehicle registration plates for a match and, as the case may be, determines the average speed of the vehicle from the acquired corresponding detection times and the known length of the section of road and compares this average speed with a specified maximum speed in order to transmit a signal when this maximum speed is exceeded, wherein at least one additional camera, which communicates with the computing and storage unit and is directed to the roadway, and a flash connected to the additional camera are provided so that a high-resolution image recording of the driver can be triggered with simultaneous illumination in case a signal is sent, characterized in that a speed sensor is provided which is connected to the additional camera and to the computing and storage unit and which acquires the instantaneous velocity of the vehicle at the exit point, and the computing and storage unit is constructed in such a way that it can determine, from the instantaneous velocity at the exit point and from the known distance of a predetermined photograph point from the exit point, the time required for the vehicle to have arrived at the photograph point so as to trigger the additional camera after this time.

6. Arrangement according to claim 5, characterized in that the speed sensor is the second detection unit.

7. Arrangement according to claim 6, characterized in that the second detection unit is a radar sensor which, first, detects the vehicle, second, acquires the instantaneous velocity of the vehicle, and, third, acquires the detection location so that the vehicle can be associated with a traffic lane of the roadway and the additional camera associated with the relevant traffic lane is triggered.

8. Arrangement according to claim 7 for stationary application, characterized in that the first detection unit and second detection unit are mounted above the roadway and are formed, respectively, by a laser scanner which is directed perpendicular to the roadway and a laser scanner which is directed oblique to the roadway.

9. Arrangement according to claim 6 for mobile application, characterized in that the first detection unit and second detection unit are laser scanners which are positioned next to the roadway in such a way that the scanning plane of the first laser scanner is oriented vertically and the scanning plane of the second laser scanner is oriented horizontally so that the first laser scanner can detect the vehicle a first time and, for purposes of classification, can capture the side profile of the vehicle, and the second laser scanner can detect the vehicle a second time and can acquire the instantaneous velocity thereof.

* * * * *